US008866577B2

(12) United States Patent
Maeda et al.

(10) Patent No.: US 8,866,577 B2
(45) Date of Patent: Oct. 21, 2014

(54) COIL COMPONENT

(75) Inventors: Hiroshi Maeda, Tokyo (JP); Katsumi Kobayashi, Tokyo (JP); Nobuo Kitajima, Tokyo (JP); Kiho Hwang, Seoul (KR)

(73) Assignees: TDK Corporation, Tokyo (JP); TDK Korea Corporation, Seoul (KR)

( * ) Notice: Subject to any disclaimer, the term of this patent is extended or adjusted under 35 U.S.C. 154(b) by 146 days.

(21) Appl. No.: 13/467,759

(22) Filed: May 9, 2012

(65) Prior Publication Data

US 2012/0286919 A1 Nov. 15, 2012

(30) Foreign Application Priority Data

May 9, 2011 (JP) ..... 2011-104009

(51) Int. Cl.
*H01F 27/30* (2006.01)

(52) U.S. Cl.
USPC ..... 336/198

(58) Field of Classification Search
USPC ..... 336/196, 198, 223–225, 200, 232
See application file for complete search history.

(56) References Cited

U.S. PATENT DOCUMENTS

| | | | | |
|---|---|---|---|---|
| 1,730,240 | A * | 10/1929 | Piper | 336/121 |
| 6,344,786 | B1 * | 2/2002 | Chin | 336/198 |
| 6,727,793 | B2 * | 4/2004 | Piechnick | 336/198 |
| 6,734,777 | B2 * | 5/2004 | Yeh et al. | 336/208 |
| 8,018,314 | B2 * | 9/2011 | Zeng et al. | 336/208 |
| 2008/0100407 | A1 | 5/2008 | Yamaguchi et al. | |

FOREIGN PATENT DOCUMENTS

JP 2008-112753 5/2008

* cited by examiner

*Primary Examiner* — Tuyen Nguyen
(74) *Attorney, Agent, or Firm* — Muncy, Geissler, Olds & Lowe, P.C.

(57) ABSTRACT

The present invention provides a coil component which is possible to be thinner with less leakage flux toward upward and downward directions, and to sustain a good insulation. The coil component comprises a core including two opposing parts mutually opposing, two side legs mutually connect both ends of the two opposing parts, and a middle leg placed between the two side legs and mutually connect central parts of the two opposing parts, a primary coil, which goes around outer circumference of the middle leg, and a secondary coil, which goes around outer circumference of the primary coil, wherein; a distance between outer perimeter edge of the primary coil and inner perimeter edge of the secondary coil varies along circumferential direction.

5 Claims, 7 Drawing Sheets

COIL COMPONENT

BACKGROUND OF THE INVENTION

1. Field of the Invention

The present invention relates to a coil component preferably used for a resonance transformer and the like.

2. Description of the Related Art

Coil components are used in various electrical products for various uses. For instance, when driving backlight of liquid glass display, inverter resonance transformer is used to obtain a high-voltage.

Resonance transformer is requested to realize outward requirements such as low profile, in addition to electric characteristics such as occurrence of suitable leakage inductance. In order to meet such requirements, prior art proposes a coil component which is a horizontal-type wherein axial direction of core is parallel to the mounting surface, and which is a split structure wherein a primary coil and a secondary coil are separately arranged along the axial direction of core. Further, there is an advantage that the coil component of the split structure is relatively easy to insulate.

For instance, Japanese unexamined patent publication No. 2008-112753 discloses a coil component which is a horizontal-type and which is a split structure wherein a primary coil and a secondary coil are separately arranged along the axial direction of core.

SUMMARY OF THE INVENTION

The coil component according to prior arts has problems wherein a leakage flux occurs toward downward direction of a mounting surface of the coil component or toward upward direction, which is opposite direction of the downward direction. For instance, as for a resonance transformer used for a backlight of liquid crystal display television, iron constructional material and the like may be disposed upward and downward directions of the coil component. Leakage flux from the coil component may cause eddy current in constructional material, and there may be a problem that heat or noise associated with said occurrence of eddy current may be caused. Further, in order to prevent such leakage flux toward upward and downward directions, it is possible to implement an aluminum board on upward and downward directions of the coil component. However, with this implement, exoergic of a coil may be deteriorated.

The present invention has been made by considering the above circumstances, and a purpose of the present invention is to provide a coil component which is possible to be thinner with less leakage flux toward upward and downward directions, and to sustain a good insulation.

Coil component according to the present invention comprises a core including mutually opposing two opposing parts, two side legs mutually connect both ends of the two opposing parts, and a middle leg placed between the two side legs and mutually connect central parts of the two opposing parts, a primary coil, which goes around outer circumference of the middle leg, and a secondary coil, which goes around outer circumference of the primary coil, wherein a distance between an outer perimeter edge of the primary coil and an inner perimeter edge of the secondary coil varies along circumferential direction.

The coil component according to the present invention, distance between outer perimeter edge of the primary coil and inner perimeter edge of the secondary coil varies along circumferential direction. Therefore, according to the coil component of the present invention, leading of wire from primary coil can be performed by using an area where distance between outer perimeter edge of primary coil and inner perimeter edge of secondary coil is large. Therefore, although a coil component according to the present invention is a double structure wherein secondary coil goes around outer circumference of the primary coil, it provides a preferable insulating characteristic. Further, since a coil component according to the present invention is a double structure, lengths of middle leg and side legs of the core can be shortened to increase the core strength.

Further, the primary coil may be bilaterally symmetric about a reference axis, which passes through a central axis of the middle leg and is parallel to a first direction which is an array direction of the side legs and the middle leg in the core, and the secondary coil may be bilaterally unsymmetric about the reference axis.

When the secondary coil is bilaterally unsymmetric about the reference axis, an area, where distance between outer perimeter edge of the primary coil and inner perimeter edge of the secondary coil is large, can be formed at a place distant from the core. Such coil component enables to lengthen the creeping distance between wire and core by wiring primary coil in an area where distance between outer perimeter edge of the primary coil and inner perimeter edge of the secondary coil is large; and that preferable insulating characteristic can be provided.

Further, winding shape of the secondary coil may be an egg shape comprising a bottom, located on one edge of a long axis, and a top, located on the other edge of the long axis and having larger curvature than the bottom, the long axis of the secondary coil may be placed to be vertical to the first direction, which is an array direction of the side legs and the middle leg of the core, and the top of the secondary coil may be placed more distant from the outer perimeter edge of the primary coil than the bottom of the secondary coil.

Such coil component forms an area, where distance between outer perimeter edge of the primary coil and inner perimeter edge of the secondary coil is large, between a top of the secondary coil and the primary coil. The top is positioned on the edge of a long axis vertical to the first direction, and that a distance from the core is long. Therefore, such coil component enables to provide preferable insulating characteristic by lengthening creeping distance between the wire and the core. Further, by making secondary coil an egg shape, length of the winding can be suppressed compared to an ellipse shape and the like.

Further, coil component according to the present invention may comprise a bobbin having a basal part, which extends in parallel with a mounting surface and a terminal is mounted on an edge, and a first hollow part, which stands out vertically from the basal part to the mounting surface, is inserted by the middle leg of the core, and is wound by the primary coil, and a case having an upper surface provided opposing to basal part of the bobbin, and a second hollow part, which extends from the upper surface to the basal part vertically to the upper surface in order to internally house the primary coil, and is wound by the secondary coil.

Such coil component is a vertical type, wherein axis direction of the core is vertical to the mounting surface, and that opposing parts of the core are placed upward and downward directions of primary coil and secondary coil. Therefore, such coil component enables to make leakage flux toward upward and downward directions small, and to prevent occurrence of eddy current and occurrence of heat and noise associated with the occurrence of eddy current in surrounding parts. Further, such coil component does not require placing aluminum board and the like to prevent leakage flux, and that preferable radiation characteristic can be provided. Furthermore, a case determining a part of outer shape is also a bobbin of the secondary coil, therefore, number of parts can be reduced even though it is a double structure. Further, although it is a vertical type, the coil component can be made thinner since it is a double structure. Further, resistance to an impact characteristic is good, due to short legs of the core.

A communication path may be formed in the basal part of the bobbin, which communicates external area and an area formed between the outer perimeter edge of the primary coil and the inner perimeter edge of the secondary coil, and a lead part, which connects the primary coil and the terminal, may pass through the communication path.

Such coil component enables to make creeping distance between the core and the lead part large, and a length of the lead part short.

The lead part, which connects the primary coil and the terminal, may comprise a horizontal lead part and a vertical lead part, the horizontal lead part is placed between outer perimeter edge of the primary coil and inner perimeter edge of the secondary coil, and is pulled out from the outer perimeter edge of the primary coil in parallel to the mounting surface, the vertical lead part is pulled out from the horizontal lead part in vertical to the mounting surface.

Such coil component includes lead parts comprising a horizontal lead part and a vertical lead part, therefore, creeping distance between the core and the lead part can be large obtaining preferable insulating characteristic.

DETAILED DESCRIPTION OF THE INVENTION

Figure 1:
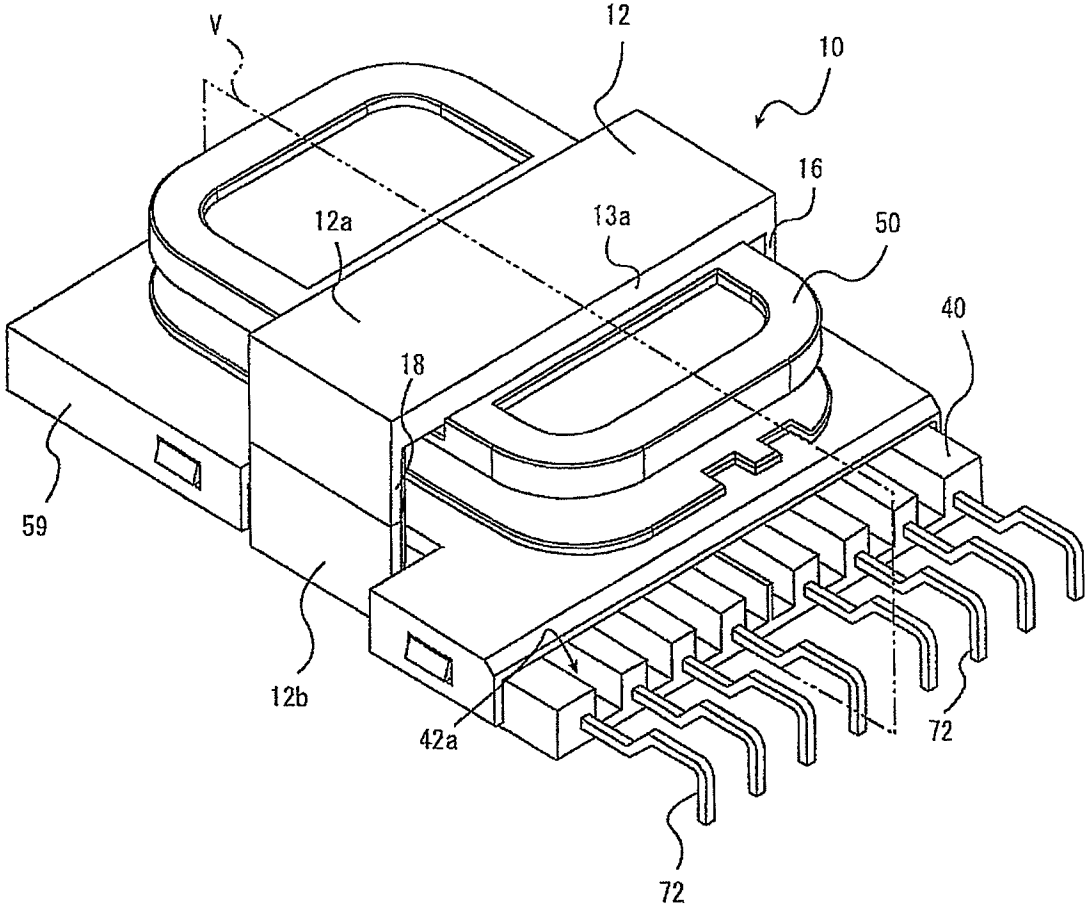
FIG. 1 is an overall perspective view of a coil component according to an embodiment of the present invention.

FIG. 1 is a perspective view of coil component 10 according to an embodiment of the present invention. Coil component 10 comprises core 12, bobbin 40 and case 50. Further, coil component 10 comprises primary coil and secondary coil, which are not shown in FIG. 1.

Figure 2:
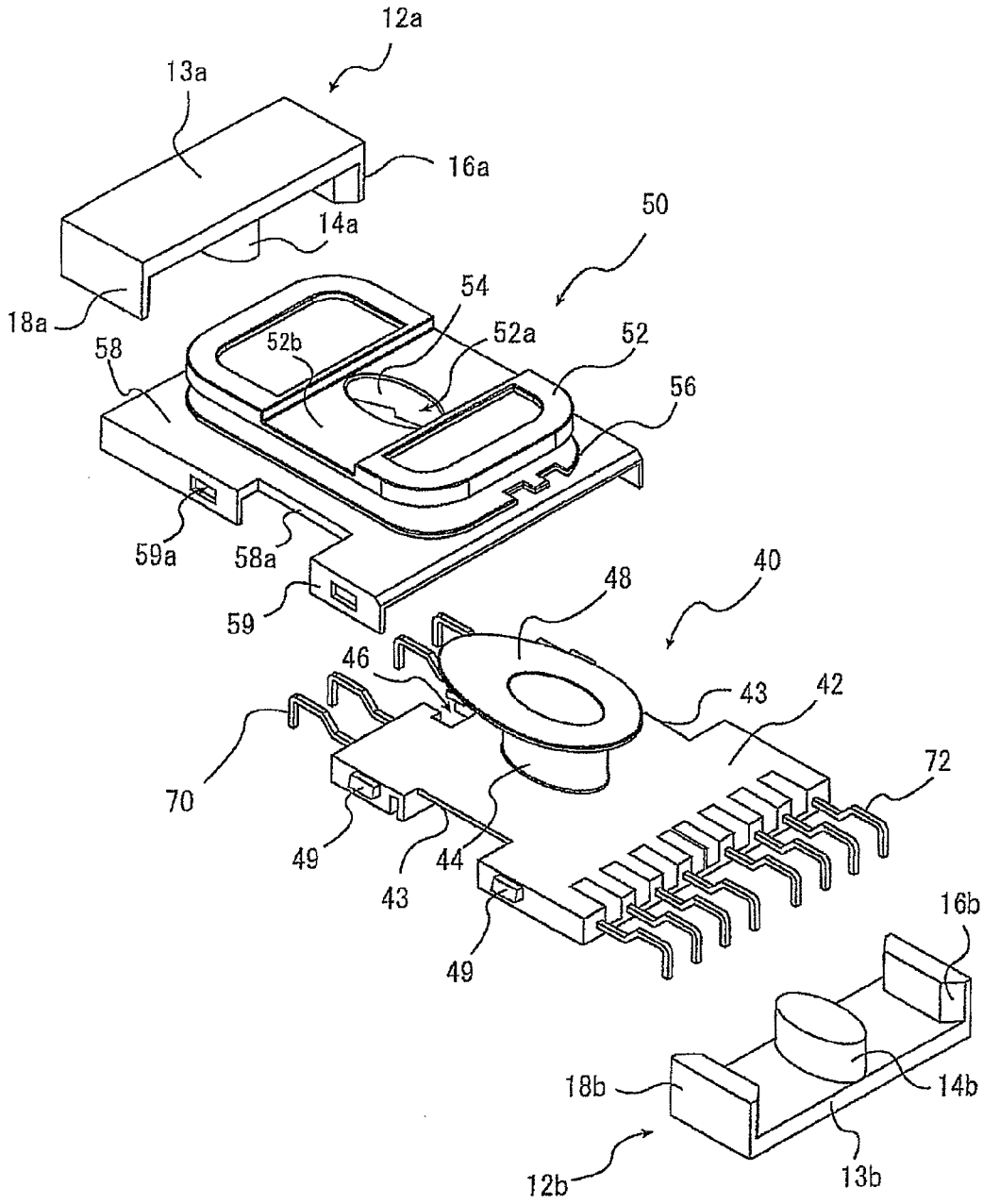
FIG. 2 is an exploded perspective view of the coil component shown in FIG. 1.

FIG. 2 is an exploded perspective view of coil component 10 shown in FIG. 1. As is the same with FIG. 1, FIG. 2 abbreviates the primary coil and the secondary coil. Core 12 of coil component 10 forms a flux path where flux passes. Core 12 is formed by assembling the first section 12*a* and the second section 12*b*, which are separately formed two components. Symmetrically shaped first section 12*a* and second section 12*b* are attached to each other, sandwiching case 50 and bobbin 40 from upward and downward directions.

Core 12 comprises two opposing parts 13*a*, 13*b*, which mutually oppose in up-and-down directions, and side legs 16, 18 and middle leg 14, which connect the two opposing parts 13*a*, 13*b*. As is shown in FIG. 1, side legs 16, 18 mutually connect both edges of the two opposing parts 13*a*, 13*b* with one another. Middle leg 14 is disposed between the two side legs 16, 18, and connects central parts of the two opposing parts 13*a*, 13*b* with one another (See FIG. 5). As is shown in FIG. 2, before setup, side legs 16, 18 and middle leg 14 are separated into the first section 12*a*, including side legs of the first section 16*a*, 18*a* and a middle leg of the first section 14*a*, and the second section 12*b*, including side leg of the second section 16*b*, 18*b* and a middle leg of the second section 14*b*. Each of the side legs and middle leg of the first section 16*a*, 18*a*, 14*a* is directly or indirectly, via gap material, joined to the corresponding side legs and middle leg of the second section 16*b*, 18*b*, 14*b*.

Bobbin 40 holds primary coil 20 (See FIG. 3 and the like), primary terminal 70 and secondary terminal 72. Bobbin 40 comprises basal part 42, the first hollow part 44, bobbin collar part 48, and etc. Basal part 42 extends parallel to a mounting surface and has a rectangle plate formation. Primary terminal 70, electrically connected to primary coil 20, and secondary terminal 72, electrically connected to secondary coil 30 (See FIG. 4 and the like), are mounted to both edges of basal part 42 in long side direction. Concave parts 43 is formed, allowing passages of side legs 16, 18 in core 12, on both edges of basal part 42 in short side direction. Further, an engaging projection 49 engages with an engaging hole 59*a* of case 50 on a side of basal part 42.

Figure 6:
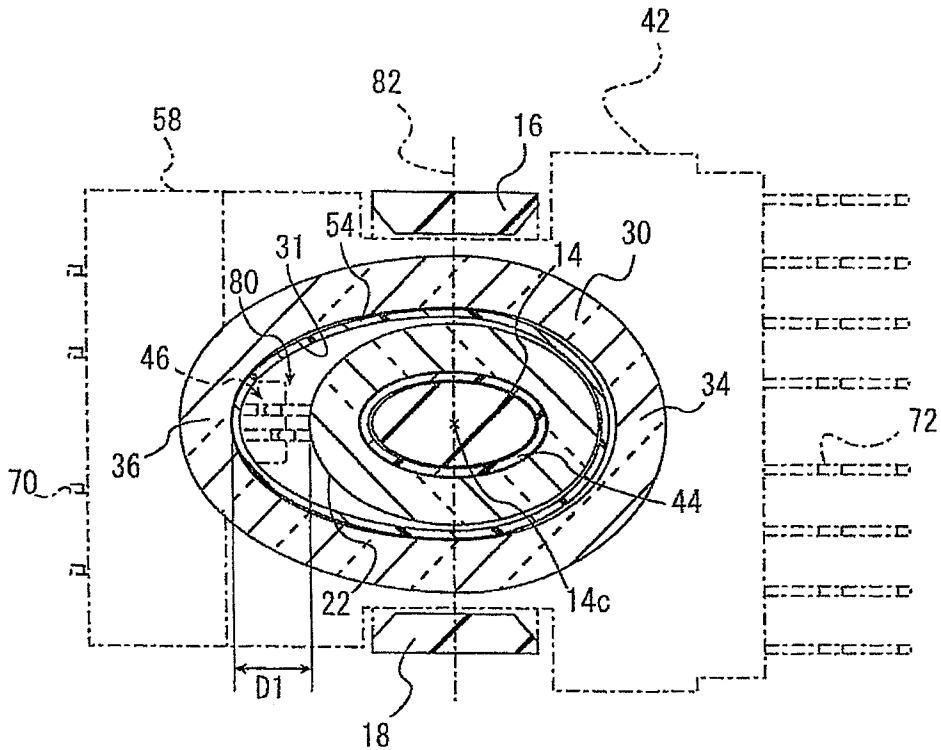
FIG. 6 is a cross sectional view of a coil component seen from a cross section parallel to mounting surface.

The first hollow part 44 of bobbin 40 stands out vertically upward from basal part 42. The first hollow part 44 has a hollow shape. A cross sectional shape of the first hollow part 44 in a cross section parallel to the mounting surface has an ellipse shape, as is shown in FIG. 6 and the like. As is shown in FIG. 2, middle leg 14 of core 12 passes through inside of the first hollow part 44. Further, primary coil 20(See FIG. 3 and the like) winds around outer perimeter of the first hollow part 44. Therefore, the first hollow part 44 functions as bobbin body of primary coil 20. Bobbin collar part 48 is formed on the upper edge of the first hollow part 44. Bobbin collar part 48 projects from the first hollow part 44 in a radial direction, and has a function to hold primary coil 20.

Figure 3:
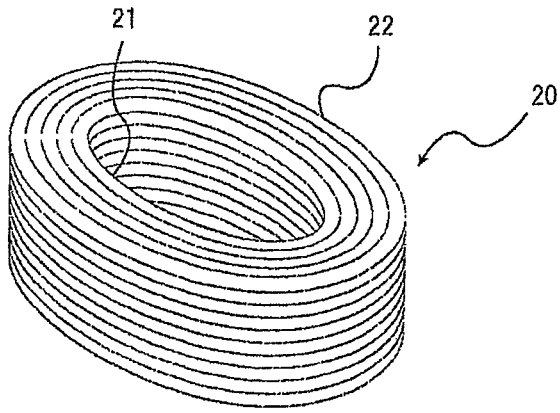
FIG. 3 is a perspective view of primary coil.

FIG. 3 is a perspective view of primary coil 20, which winds around the first hollow part 44 (See FIG. 2). Primary coil inner perimeter edge 21, an inner perimeter edge of primary coil 20, contacts with the first hollow part 44. Winding shape of primary coil 20 is, as is the same with the cross sectional shape of the first hollow part 44, an ellipse shape.

Figure 4:
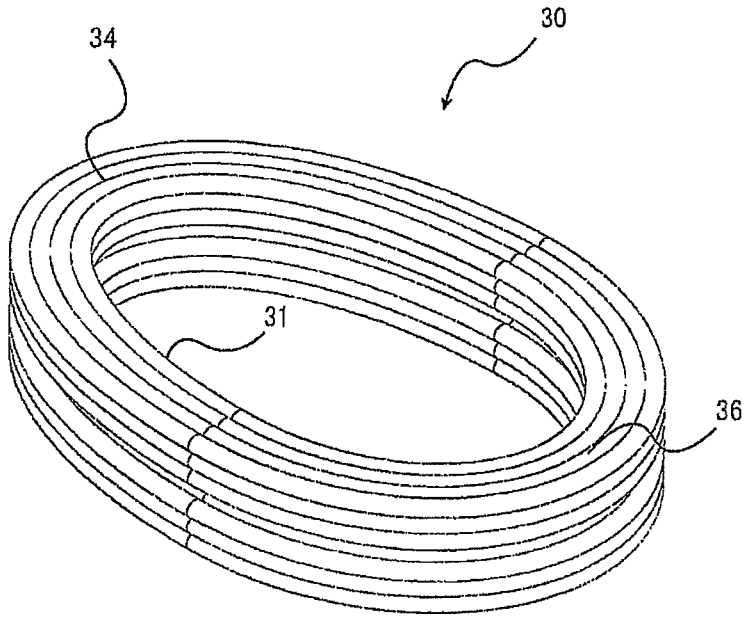
FIG. 4 is a perspective view of secondary coil.

Case 50, shown in FIG. 2, determine a part of an outer shape of coil component 10, along with holding secondary coil 30 (See FIG. 4 and the like). Case 50 comprises upper surface part 52, second hollow part 54, under surface part 58 and side surface part 59, and etc. Upper surface part 52 is provided opposing to basal part 42 of bobbin 40, and is extended in parallel with the mounting surface. Upper surface part 52 forms through hole 52*a*, in order to insert middle leg 14 of core 12. Upper surface part 52 further forms installation groove part 52*b*, in order to install opposing part 13*a* of core 12.

Figure 5:
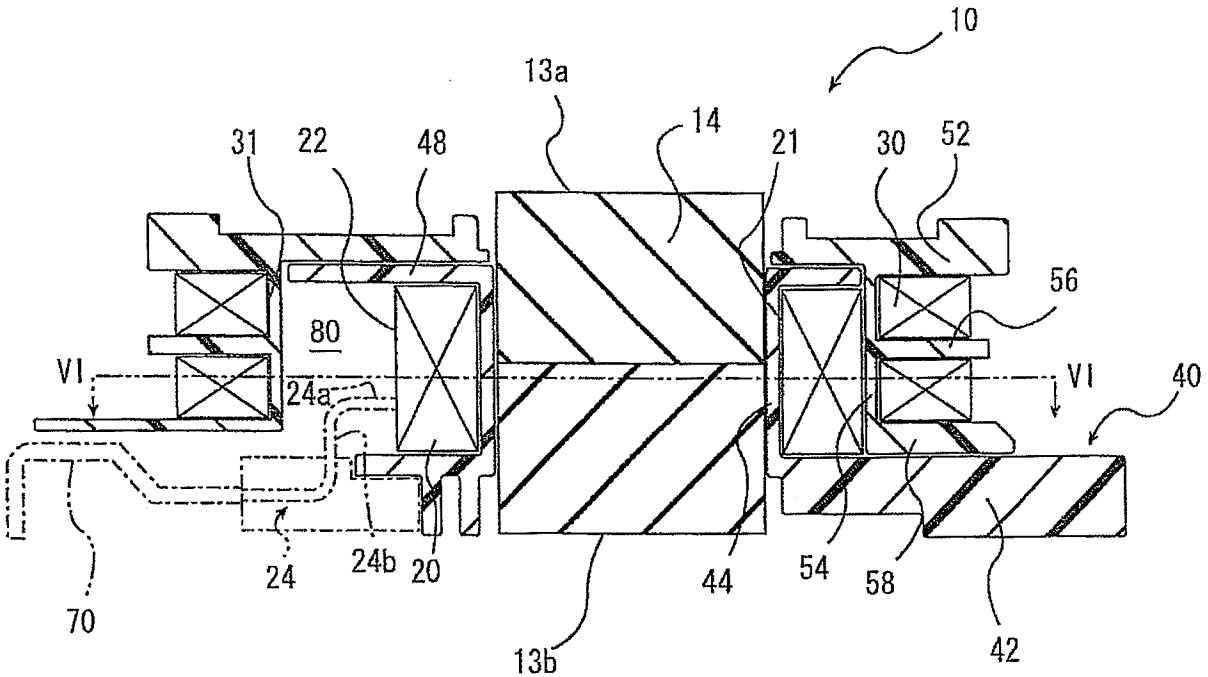
FIG. 5 is a cross sectional view of a coil component seen from a cross section vertical to mounting surface.

The second hollow part 54 of case 50 stands out vertically downward from upper surface part 52. FIG. 5 is a cross sectional view of coil component 10, which is a cross section vertical to the mounting surface (See cross sectional line V of FIG. 1). Second hollow part 54 is formed to internally house primary coil 20 and middle leg 14. In other word, middle leg 14 and primary coil 20 pass through inside the second hollow part 54. Secondary coil 30 winds around outer perimeter of the second hollow part 54. Intermediate collar part 56, in order to partition-place the secondary coil 30, is placed on outer perimeter of the second hollow part 54 in accordance with the use of coil component 10 and the like. As mentioned above, the second hollow part 54 functions as a bobbin body on the secondary coil 30. Further, as is shown in FIG. 5, coil component 10 has a double structure, wherein primary coil 20 and secondary coil 30 go doubly-around periphery of middle leg 14 of core 12.

As is shown in FIG. 6, a cross sectional shape of the second hollow part 54 in a cross section parallel to the mounting surface has an egg-shape wherein curvature of both edges in its long axial direction of an ellipse are deformed asymmetry. Note that internal shape of coil component 10 will be mentioned hereinafter.

As is shown in FIG. 2, under surface part 58 of case 50 is set to cover the upper side surface of basal part 42 of bobbin 40. As is shown in FIG. 5, under surface part 58 is connected to upper surface part 52 via second hollow part 54. Under surface part 58 is projected toward parallel direction of mounting surface from the second hollow part 54, and as is shown in FIG. 2, has an outer perimeter shape of nearly rectangle. As is the same with basal part 42 of bobbin 40, concave part 58*a* is formed, allowing passages of side legs 16, 18 of core 12, on both edges of under surface part 58 in short side direction. Further, downwardly-extending side surface part 59 is formed on both edges along edge sides of under surface part 58. Engaging hole 59*a* is formed on side surface part 59 which engages with engaging projection 49 of bobbin 40.

FIG. 4 is a perspective view of secondary coil 30, which winds around the second hollow part 54. According to the present embodiment, although secondary coil 30 is constituted from the two independent coils, it may be constituted from one coil or from 3 or more coils. Secondary coil inner perimeter edge 31, an inner perimeter edge of secondary coil 30, contacts with the second hollow part 54. Winding shape of the secondary coil inner perimeter edge 31 is, as is the same with the cross sectional shape of the second hollow part 54, an egg-shape.

FIG. 5 is a cross sectional view of coil component 10, which is a cross section of cross sectional line V shown in FIG. 1. Note that FIG. 5 shows the primary coil 20 and the secondary coil 30. A coil component 10 is a vertical type, wherein an axial direction (flux flowing direction) of middle leg 14 is vertical to the mounting surface. According to coil component 10 of vertical type, as is shown in FIGS. 1 to 5, opposing parts 13*a*, 13*b* of core 12 are placed upward and downward directions of primary and secondary coils 20, 30, and that these opposing parts 13*a*, 13*b* suppress leakage flux toward upward and downward directions. Therefore, leakage flux of coil component 10 toward upward and downward directions can be suppressed, compared to a horizontal type wherein upward and downward directions of coil are hardly shielded by core.

Further, as is shown in FIG. 5, coil component 10 is a double structure wherein secondary coil 30 goes around outer perimeter of primary coil 20. With the double structure, length of axial direction of core 12 in coil component 10 can be shortened, and that vertical type as well as thin type coil can be realized. Here, a coil component of double structure according to prior arts comprises a primary coil wherein its outer perimeter is covered with secondary coil, and that wiring from primary coil to terminal must avoid the secondary coil in up-and-down directions. However, when wiring is realized with the coil component according to the prior arts, there was a problem either thinning or insulation characteristic will be deteriorated. For instance, when wiring of primary coil 20 is pulled downward in a vertical direction from primary coil 20 penetrating basal part 42 of bobbin 40, creeping distance between opposing part 13*b* of core 12 and lead part 24 becomes small and a problem wherein securing insulating characteristic becomes difficult.

Considering above, coil component 10 according to the present embodiment sets intermediate region 80 between primary coil outer perimeter edge 22 and secondary coil inner perimeter edge 31 by changing distance along circumferential direction between primary coil outer perimeter edge 22 and secondary coil inner perimeter edge 31. Coil component 10 sets lead part 24 of primary coil 20 in this intermediate region 80, which makes wiring from primary coil 20 to primary terminal 70 easy and creeping distance between core 12 and lead part 24 large.

FIG. 6 is a cross sectional view along a cross sectional line VI-VI as shown in FIG. 5, and is a cross sectional view of coil component 10 which is horizontal to the mounting surface. As is shown in FIG. 6, winding shape of primary coil 20 is an ellipse shape; and short axial direction of the ellipse shape is parallel to first direction, which is an array direction of middle leg 14 and side legs 16, 18. Therefore, primary coil 20 passes through central axis 14*c* of middle leg 14 in core 12; and bilaterally symmetric about reference axis 82, which is parallel to first direction.

Further, winding shape of secondary coil 30 is an egg shape; and long and short axial directions of the egg shape coincide with short and long axial directions of the ellipse shape, which is a winding shape of primary coil 20. Namely, long axis of the egg shape of secondary coil 30 is vertical to the first direction, an array direction of middle leg 14 and side legs 16, 18. Secondary coil 30 comprises bottom 34, located on one edge of long axis, and top 36, located on the other edge and has larger curvature than bottom 34. Therefore, secondary coil 30 is bilaterally unsymmetric about reference axis 82.

At an inner perimeter side of top 36 of secondary coil 30, distance between primary coil outer perimeter edge 22 and secondary coil inner perimeter edge 31 becomes long, and that intermediate region 80 will be large. On the other hand, at an inner perimeter side of bottom 34 of secondary coil 30, primary coil outer perimeter edge 22 is proximally positioned to secondary coil inner perimeter edge setting second hollow part 54 in between; and that intermediate region 80 is small. Maximum value D1 of a distance between primary coil outer perimeter edge 22 and secondary coil inner perimeter edge 31, is adjusted according to a required creeping distance D2 and the like (See FIG. 7 and the like).

As is mentioned above, in coil component 10, winding shapes of primary coil 20 and secondary coil 30 are made different from each other. This makes distance between primary coil outer perimeter edge 22 and secondary coil inner perimeter edge 31 to vary along circumferential direction, in order to form intermediate region 80. Note that intermediate region 80 may be formed by displacing center position of secondary coil 30 from central axis 14*c* of middle leg 14.

As is shown in FIG. 5, lead part 24 connects primary terminal 70, which is mounted to bobbin 40, and primary coil 20. As is shown in FIGS. 2 and 6, communication path 46, which communicates external side of coil component 10 with intermediate region 80, is formed in basal part 42 of bobbin 40. Communication path 46 is configured with a cutout, a through hole, a trench and the like formed on basal part 42. As is shown in FIG. 7, lead part 24 passes communication path 46, and connects primary coil 20 and primary terminal 70.

As is shown in FIG. 5, lead part 24 comprises horizontal lead part 24*a*, pulled out from primary coil outer perimeter edge 22 in parallel direction of mounting surface, and vertical lead part 24*b*, pulled out from horizontal lead part 24*a* in vertical direction of mounting surface. Horizontal lead part 24*a* is positioned in intermediate region 80; while vertical lead part 24*b* passes communication path 46 and is positioned over external and internal of intermediate region 80.

Figure 7:
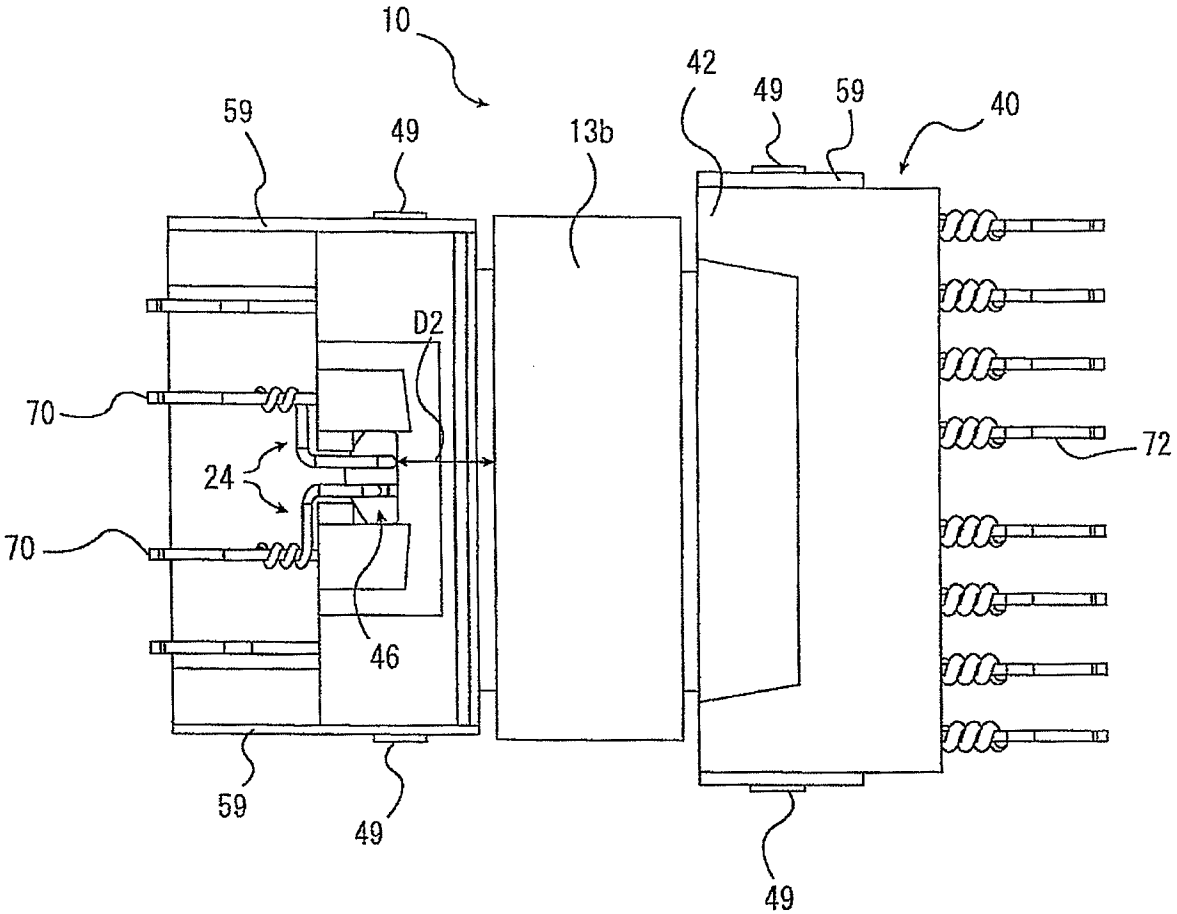
FIG. 7 is a bottom view of the coil component shown in FIG. 1.

FIG. 7 is a bottom view, in which coil component 10 is observed from below. Lead part 24 is pulled to long side direction of bobbin 40 by horizontal lead part 24*a* shown in FIG. 5, passes communication path 46 and exposed to bottom side of coil component 10. Therefore, coil component 10 can provide preferable insulating characteristic, due to a long creeping distance D2 between opposing part 13*b* of core 12 and lead part 24. For instance, creeping distance D2 may be 4 to 12 mm or so. Further, according to coil component 10, shapes and sizes of intermediate region 80 and position of communication path 46 can be adjusted in order to adjust creeping distance D2. Note that wiring from secondary coil 30 to secondary terminal 72 passes through trench part 42*a* (See FIG. 1), formed on basal part 42, and drawn to secondary terminal 72 shown in FIG. 7.

Coil component 10 according to the present embodiment is manufactured by assembling each parts shown in FIG. 2 and winding the winding around bobbin 40 and case 50. Below, an example of manufacturing method of coil component 10 is described with FIG. 2 and the like. For manufacturing method of coil component 10, firstly, bobbin 40 mounted with primary terminal 70 and secondary terminal 72 is prepared. Although material of bobbin 40 is particularly not limited, it can be formed with an insulation material such as resin.

Next, winding is wound to first hollow part 44 of bobbin 40 and forms primary coil 20 (See FIG. 3). A winding used to form primary coil 20 is particularly not limited; however, litz wire and the like may be preferably used. Further, terminal of winding when forming primary coil 20 passes communication path 46 of bobbin 40, tangle with primary terminal 70 and constitutes lead part 24 (See FIG. 7 and the like).

Next, case 50 shown in FIG. 2 is mounted on bobbin 40, where primary coil 20 is formed. Case 50 and bobbin 40 are assembled by engaging engaging hole 59*a* of case 50 with engaging projection 49 of bobbin 40. Further, case 50 and bobbin 40 are fixed by bonding when required. Material of case 50 is particularly not limited, and can be formed with insulation material such as resin.

Next, winding is wound around second hollow part 54 of case 50, and forms secondary coil 30 (See FIG. 4). Although winding used to form secondary coil 30 is particularly not limited, litz wire and the like may be preferable used. Further, terminal of winding when forming secondary coil 30 passes trench part 42*a* of bobbin 40 and tangle with secondary terminal 72.

Next, the first section 12*a* and the second section 12*b* are mounted to an intermediate assembly, wherein primary coil 20, secondary coil 30, case 50 and bobbin 40 are assembled, from top and bottom directions forming core 12. As for a material of core 12, soft magnetic materials such as metal, ferrite and the like are exemplified, however, it is not particularly limited. First section 12*a* and second section 12*b* of core 12 are bonded by bond material or their outer perimeter is winded by a tape, in order to fix to case 50 and bobbin 40. Note that, after a set of assembly process, varnish-impregnated may be performed to coil component 10. With these processes, coil component 10 according to the present embodiment can be manufactured.

Coil component 10 is vertical type and double structured. This makes thinning possible and leakage flux toward up-and-bottom directions less. Therefore, coil component 10 can prevent occurrence of eddy current in surrounding constructional material, without aluminum shield and the like. Further, by preventing occurrence of eddy current, coil component 10 can decrease occurrence of heat or noise associated with said occurrence of eddy current. Further, coil component 10 does not require a shield to shield leakage flux, and that good radiation characteristic can be provided. Furthermore, coil component 10 provides short-lengthened middle leg 14 and side legs 16, 18 of core 12, and that damages of core 12 due to external impact and the like are prevented.

Coil component 10 has a structure wherein distance between primary coil outer perimeter edge 22 and secondary coil inner perimeter edge 31 varies along circumferential direction, and comprises intermediate region 80 which is a region between primary coil outer perimeter edge 22 and secondary coil inner perimeter edge 31. Intermediate region 80 provides a space where wires of primary coil 20 are pulled, and that coil component 10 simplifies wire route from primary coil 20 to primary terminal 70 and makes wiring of primary coil 20 easy.

As is shown in FIG. 6, intermediate region 80 is preferably widely-formed distant direction from core 12, namely, a direction vertical to first direction (array direction of core 12), when seen from a cross section parallel to the mounting surface. With this formation, coil component 10 makes creeping distance between core 12 and lead part 24 large, leading to preferably secure its insulating characteristic. Further, secondary coil 30 is made to an egg shape, so as to form intermediate region 80 while controlling an increase of the winding length.

Note that, although cross sectional shape of middle leg 14 of core 12 is an ellipse shape in the abovementioned embodiments, it is not particularly limited and may be a circle, polygonal or the other shape. Further, winding shape of primary coil 20 and secondary coil 30 is particularly not limited as long as it can form intermediate region 80. Furthermore, the name "primary" and "secondary" for coils are used for a reason of expediency, and that primary coil 20 or secondary coil 30, whichever can be an input side.

The invention claimed is:

1. A coil component comprising a core including two opposing parts mutually opposing, two side legs mutually connect both ends of the two opposing parts, and a middle leg placed between the two side legs and mutually connect central parts of the two opposing parts, a primary coil, which goes around outer circumference of the middle leg, and a secondary coil, which goes around outer circumference of the primary coil, wherein;

a distance between an outer perimeter edge of the primary coil and an inner perimeter edge of the secondary coil varies along circumferential direction; wherein the primary coil is bilaterally symmetric about a reference axis, which passes through a central axis of the middle leg and is parallel to a first direction which is an array direction of the side legs and the middle leg of the core, and the secondary coil is bilaterally unsymmetric about the reference axis.

2. The coil component as set forth in claim 1, wherein winding shape of the secondary coil is an egg shape comprising a bottom, located on one edge of a long axis, and a top, located on the other edge of the long axis and having larger curvature than the bottom, the long axis of the secondary coil is placed to be vertical to the first direction, which is an array direction of the side legs and the middle leg of the core, and the top of the secondary coil is placed more distant from the outer perimeter edge of the primary coil than the bottom of the secondary coil.

3. The coil component as set forth in claim 1, comprising a bobbin having a basal part, which extends in parallel with a mounting surface and a terminal is mounted on an edge, and a first hollow part, which stands out from the basal part to the mounting surface vertically, is inserted by the middle leg of the core, and is wound by the primary coil, and a case having an upper surface provided opposing to the basal part of the bobbin, and a second hollow part, which extends from the upper surface to the basal part vertically to the upper surface in order to internally house the primary coil, and is wound by the secondary coil.

4. The coil component as set forth in claim 3, wherein a communication path is formed on the basal part of the bobbin, which communicates external area and an area formed between the outer perimeter edge of the primary coil and the inner perimeter edge of the secondary coil, and a lead part, which connects the primary coil and the terminal, passes through the communication path.

5. The coil component as set forth in claim 3, wherein a lead part, which connects the primary coil and the terminal, comprises a horizontal lead part and a vertical lead part, the horizontal lead part is placed between outer perimeter edge of the primary coil and inner perimeter edge of the secondary coil, and is pulled out from the outer perimeter edge of the primary coil in parallel to the mounting surface, and the vertical lead part, is pulled out from the horizontal lead part in vertical to the mounting surface.

* * * * *